US005188350A

United States Patent [19]

Hayashi

[11] Patent Number: 5,188,350

[45] Date of Patent: Feb. 23, 1993

[54] PAPER FEEDER WITH STATIONARY AND FREE PAPER FEED ROLLERS

[75] Inventor: Takayuki Hayashi, Nagoya, Japan

[73] Assignee: Brother Kogyo Kabushiki Kaisha, Nagoya, Japan

[21] Appl. No.: 803,455

[22] Filed: Dec. 6, 1991

[30] Foreign Application Priority Data

Feb. 12, 1991 [JP] Japan ..... 3-19051

[51] Int. Cl.[5] ..... B65H 3/06

[52] U.S. Cl. ..... 271/114; 271/119

[58] Field of Search ..... 271/119, 120, 114, 116, 271/270

[56] References Cited

U.S. PATENT DOCUMENTS 4,438,915 3/1984 Akamatsu et al. ..... 271/9

FOREIGN PATENT DOCUMENTS 59-185673 10/1984 Japan .
0258029 12/1985 Japan ..... 271/119
0123729 5/1988 Japan ..... 271/119
0150640 6/1989 Japan ..... 271/119
0220649 9/1989 Japan ..... 271/119

*Primary Examiner*—H. Grant Skaggs
*Assistant Examiner*—Carol Lynn Druzbick
*Attorney, Agent, or Firm*—Oliff & Berridge

[57] ABSTRACT

A sheet feeder having a stationary sheet feed rollers fixed on and rotatable integrally with a rotary shaft, each having a sheet contact portion for contact with the uppermost one of a plurality of sheets and a relief portion spaced from the uppermost sheet. Freely rotatable feed rollers are fitted on the rotary shaft and each free roller has contact portion for contact with the uppermost sheet and a relief portion spaced from the uppermost paper. Urging members for urging engagement members on the stationary sheet feed rollers into engagement with engagement recesses on the free sheet feed rollers in normal state are disposed on the shaft. A pair of transportation rollers are disposed upstream in the sheet transportation direction beyond the stationary and free sheet feed rollers. Upon the rotation of the stationary sheet feed rollers, the stationary and free sheet feed rollers feed the uppermost one of the plurality of sheets. The stationary sheet feed rollers come to a halt with the paper relief portions facing the uppermost sheet when the leading edge of the uppermost sheet reaches the transportation rollers.

20 Claims, 6 Drawing Sheets

PAPER FEEDER WITH STATIONARY AND FREE PAPER FEED ROLLERS

BACKGROUND OF THE INVENTION

1. Field of the Invention

The present invention relates to a paper feeder for supplying paper from a paper cassette to an apparatus and, more particularly, to a paper feeder provided with stationary paper feed rollers fixed on a rotary shaft and a free paper feed roller rotatably fitted on the rotary shaft.

2. Description of the Related Art

Paper feeders for supplying paper from a paper cassette containing a plurality of paper sheets therein to a print unit housed in an apparatus are known. The paper cassette is detachably attached in the apparatus. Above the paper cassette, paper feed rollers, which are rotated by a motor, are disposed on the side of the apparatus.

The paper feed rollers are brought into contact with the uppermost one of the paper sheets contained in the paper cassette, and feed the paper sheets, one after another, in sequence from the uppermost paper sheet to the print unit of the apparatus by rotation. The paper feed rollers are brought into a non-contact relationship with the sheet of paper after or as the sheet feeding is taken over by other means in the transport system.

Namely, the paper is transported by transportation rollers provided in the paper transportation path of the apparatus after a predetermined length of feed from the paper cassette. Accordingly, the paper feed rollers are kept in non-contact state with the paper after the paper feed so as not to prevent the drive of the transportation rollers.

Consequently, various paper feed rollers have been devised which switch the paper feed rollers between a contact and a non-contact state with the paper so as to smoothly feed the paper.

A paper feeder, where a part of a circular roller is cut off to obtain a paper feed roller having a sectorial cross-section, is disclosed in U.S. Pat. No. 4,438,915, wherein the paper can be fed according to the rotation of the sectorial roller. In this paper feeder, the paper is fed by a predetermined distance from the paper cassette with the curved portion, i.e., the arcuate portion of the sectorial roller brought into contact with the paper. And then, the chord portion of the sectorial roller is positioned opposite to the upper surface of the paper when the paper reaches the transportation rollers. The sectorial roller is brought into a non-contact relationship with the paper so that the paper is transported only by the transportation rollers.

In Japanese Patent Laid-Open Application No. 59-185673 a device is disclosed in which the contact or non-contact state between a paper feed roller having a circular cross-section and paper is switched by the feed roller. Normally in this device, the paper feed roller is urged by spring means so as to be spaced apart from the uppermost paper contained in the paper cassette in non-contact with the upper surface of the paper. Only when the paper feed roller feeds the paper, is it brought into contact with the upper surface of the paper contained in the paper cassette against the urging force of the spring means, to feed the paper.

However, there are problems in the above paper feeders, as follows:

In case of the former paper feeder employing the sectorial roller as the paper feed roller, the paper feed roller feeds the paper only by its arcuate portion, with an attendant problem of a limited feed amount of paper by the paper feed roller. The sectorial roller feeds the paper at a speed lower than that of a circular roller, thus inducing a significant problem if the feed rate of the paper must be high.

The latter paper feeder, where the paper feed roller is taken out of contact with the paper by the spring means, requires a complicated mechanism for bringing the paper feed roller into contact with the paper against the urging force of the spring means. Accordingly, the manufacturing cost of the paper feeder becomes high, and the paper feeder is likely to break down due to the complicated structure.

SUMMARY OF THE INVENTION

It is an object of the present invention to provide a paper feeder capable of securely feeding paper stacked in a paper cassette to a print unit housed in an apparatus.

It is another object of the present invention to provide a paper feeder where the non-contact state between paper feed rollers and the upper sheet of a stack of paper can be realized by a simple structure at a low cost.

It is a further object of the present invention to provide a paper feeder where the paper feed rollers can smoothly and speedily feed the paper to the print unit housed in the apparatus even if a feed rate of paper stacked in the paper cassette is high.

To achieve the above objects, the paper feeder according to the present invention comprises: a paper cassette capable of containing a plurality of paper sheets therein; a rotary shaft rotatably disposed along the direction of the width of the paper; stationary paper feed rollers fixed on and rotated with the rotary shaft, each roller having a paper contact portion where the roller is brought into contact with the uppermost one of the plurality of sheets of paper and a paper non-contact portion where the roller is not brought into contact with the uppermost sheet of paper; a free paper feed roller freely rotatably fitted in the rotary shaft and having a paper contact portion in contact with the uppermost sheet of paper and a paper non-contact portion in non-contact with the uppermost sheet of paper; engagement portions formed on the stationary paper feed roller, respectively; engaged recesses formed in the free paper feed roller and engageable with the engagement portions; urging means interposed between the stationary paper feed rollers and the free paper feed roller, respectively, and for urging engagement of the engagement portions with the engaged recesses in a normal state; and drive means for rotating the rotary shaft so as to feed the uppermost one of the plurality of sheets of paper by the stationary and free paper feed rollers according to the rotation of the stationary paper feed rollers against the urging force of the urging means.

With this arrangement, the engagement portions are engaged with the engaged recesses by the urging force of the urging means so that the stationary paper feed rollers are rotated together with the free paper feed roller. The free paper feed roller stops upon contact with the uppermost paper. After that, the paper contact portions of the stationary paper feed rollers are brought into contact with the uppermost paper, whereby the paper can be fed according to the rotation of the stationary paper feed rollers. When the engagement portions are engaged with the engaged recesses, the paper contact portion of the free paper feed roller is brought into contact with the uppermost paper sheet, so that the paper can be fed according to the rotation of the free paper feed roller.

Consequently, the paper feeder according to the present invention can feed the paper at the time of paper transportation in the same manner as a generally circular roller, while the paper can be smoothly supplied with certainty since a load from the stationary and free paper feed rollers with respect to the paper is eliminated when the paper feeder is stopped.

BRIEF DESCRIPTION OF THE DRAWINGS

A preferred embodiment of the present invention will be described in detail with reference to the following drawings, wherein.

DESCRIPTION OF THE PREFERRED EMBODIMENTS

A paper feeder embodying the present invention will be explained hereinafter with reference to the drawings.

Figure 1:
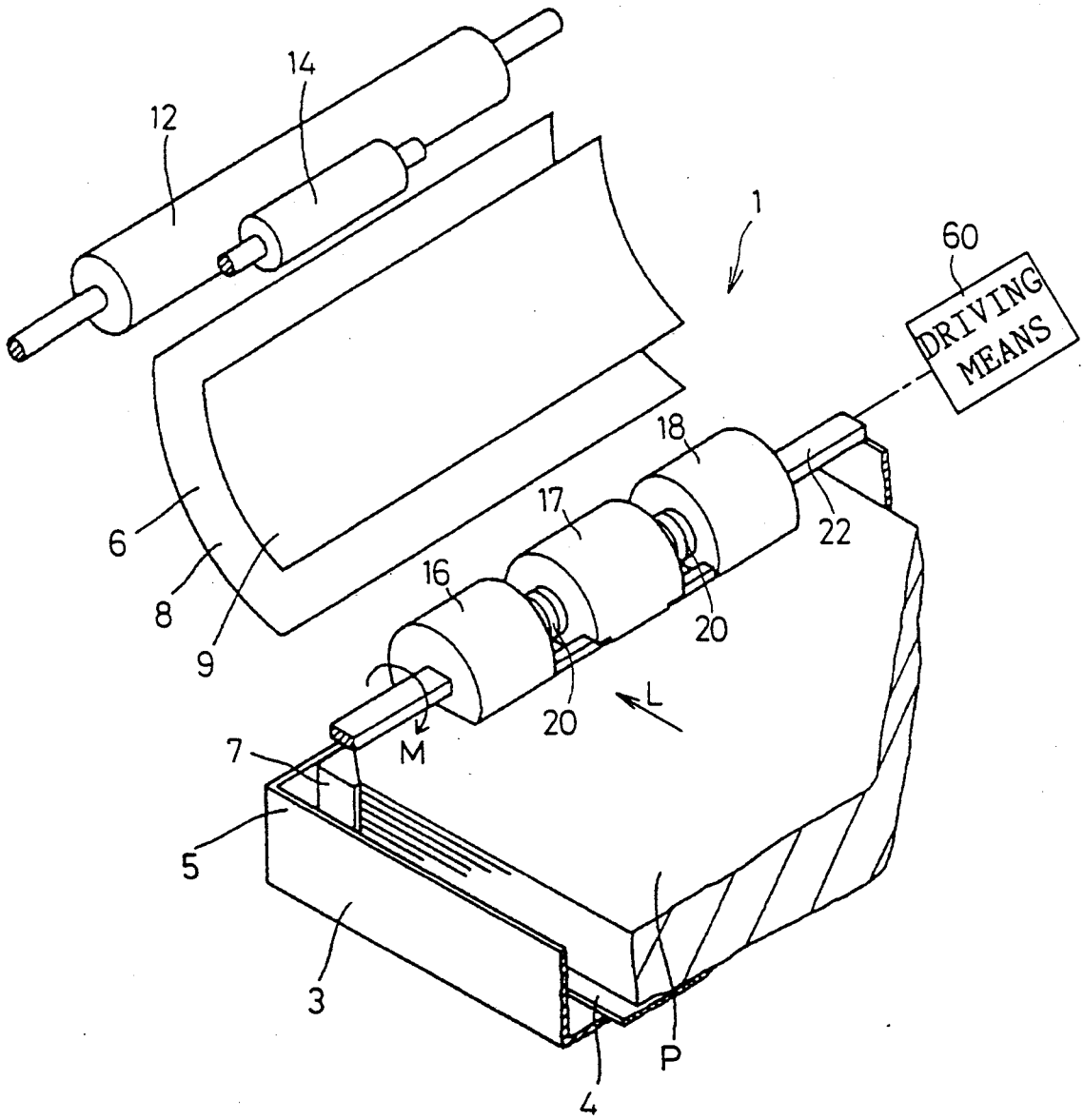
FIG. 1 is a perspective view showing a part of a paper feeder in one preferred embodiment according to the present invention.

As shown in FIG. 1, a paper feeder 1 is adapted to feed paper P contained in a paper cassette 3 to a print unit (not shown). The paper feed rollers 16, 17, 18 of the paper feeder 1 are disposed above the paper cassette 3. A plurality of paper sheets P are stacked up on the bottom plate 4 of the paper cassette 3. The bottom plate 4 is urged upward by a well-known spring or the like, to lift up the paper P. The feed rollers 16, 17, 18 are disposed slightly above the paper sheets P in a direction perpendicular to the direction of advance of the paper sheets (the direction indicated by an arrow L).

Separator pawls 7 for separating the uppermost paper sheet P by buckling are formed at the front edge 5 of the paper cassette 3 in engagement with the right and left front ends of the paper sheets P. A pair of paper guides 8, 9, which constitute a path 6 for the paper P supplied from the cassette 3, are disposed forwardly in the paper advance direction of the front edge 5 of the cassette 3. Several transportation rollers 12, 14 for transporting the paper P to the print unit (not illustrated) while holding the paper P therebetween are arranged above the paper guides 8, 9. Accordingly, the paper feeder 1 feeds the uppermost sheet of paper P one after another out of the paper stacked in the cassette 3 to the path 6 upon the rotation of the feed rollers 16, 17, 18 in the direction indicated by an arrow M. Subsequently, the paper sheets are transported to the print unit by the transportation rollers 12, 14.

Figure 2:
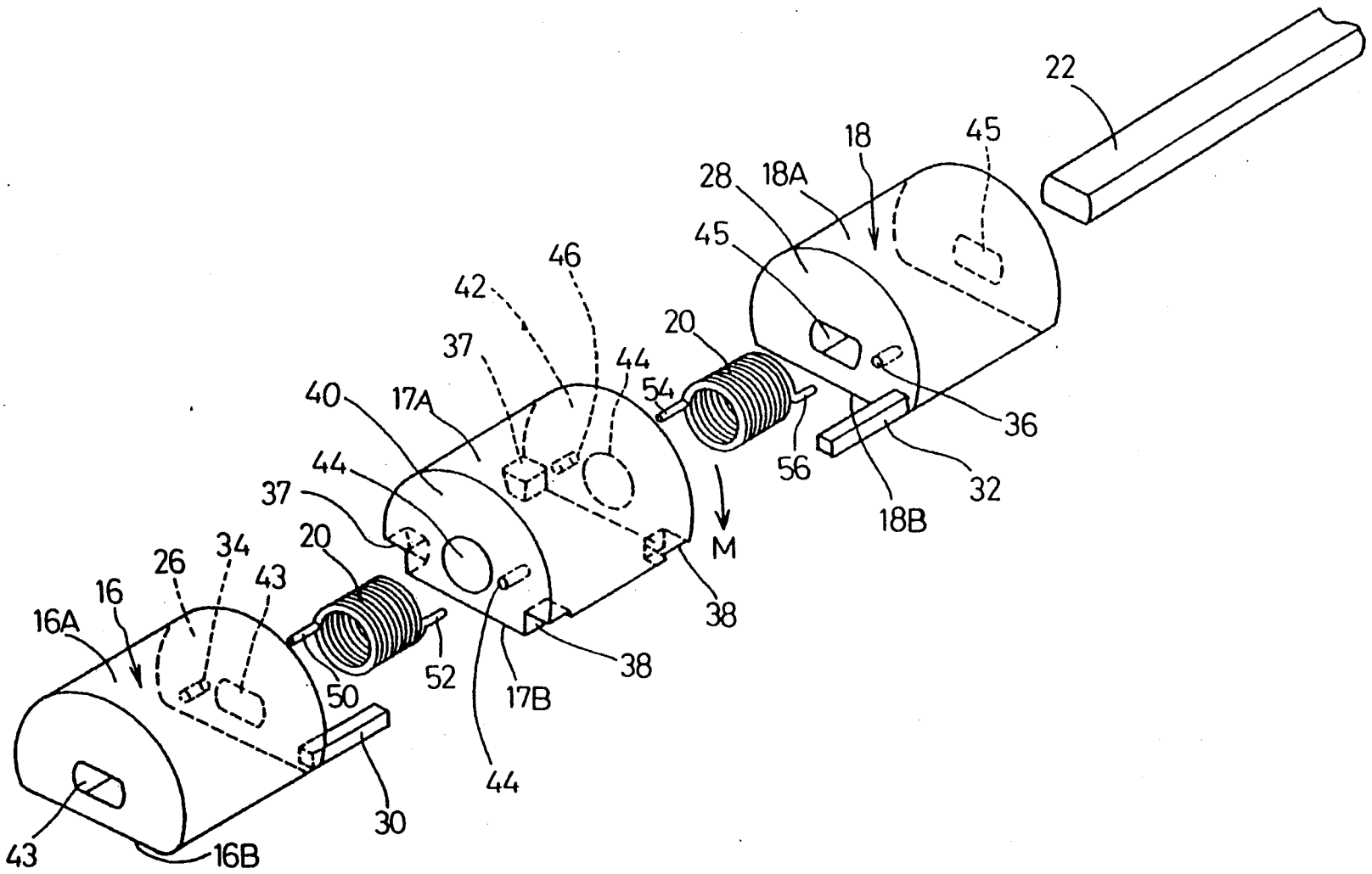
FIG. 2 is an exploded perspective view of the paper feeder in the preferred embodiment according to the present invention.

As depicted in FIG. 2, the paper feed rollers 16, 17, 18 are of a sectorial type, where a part of a circular roller made of synthetic rubber is cut off. Namely, the feed rollers 16, 17, 18 are constituted of curved portions, i.e., arcuate portions 16A, 17A, 18A, and flat portions, i.e., chord portions 16B, 17B, 18B, respectively. Three sectorial rollers so constituted as described above are combined in the axial direction of a rotary shaft 22, thus constituting the paper feed rollers. The arcuate portions 16A, 17A, 18A of the feed rollers serve as paper contact portions in contact with the paper P while the chord portions 16B, 17B, 18B function as relief portions, which do not engage or contact the paper P. The rotary shaft 22 is rotated by drive means 60.

Torque springs 20 are interposed between the paper feed rollers 16 and 17 and between the paper feed rollers 17 and 18, respectively. The rotary shaft 22 having a substantially rectangular cross-section is inserted through the three rollers 16, 17, 18 and the two torque springs 20. In the outside two 16, 18 of the three rollers are formed, in almost the center thereof, central holes 43, 45 each having substantially the same cross-section as that of the rotary shaft 22. The rotary shaft 22 is inserted into the central holes 43, 45 so that the feed rollers 16, 18 are secured to the rotary shaft 22 (hereinafter referred to as stationary feed rollers). The stationary feed rollers 16, 18 are rotated together with the rotary shaft 22.

Meanwhile, the intermediate paper feed roller 17 is provided, in almost the center thereof, with a central hole 64 having a circular cross-section. The rotary shaft 22 is inserted into the central hole 64, and the feed roller 17 (hereinafter referred to as a free feed roller) is freely rotatable with respect to the rotary shaft 22. The outer diameter of the free feed roller 17 is set slightly larger (for example, about 1 mm in diameter) than those of the stationary feed rollers 16, 18.

On the inside surfaces 26, 28 of the stationary feed rollers 16, 18 engagement members 30, 32 formed of a square rod, project inwardly. Meanwhile, at the four corners of the arcuate portion 17A of the free feed roller 17 are formed recesses 38 which are engaged with the engagement members 30, 32. At the inside faces 26, 28 of the stationary feed rollers 16, 18 opposite to the free feed roller 17 are formed spring fixing holes 34, 36 for fixing the ends 50, 56 of the torque springs 20, respectively. Meanwhile, at the side surfaces 40, 42 of the free feed roller 17 facing toward the stationary feed rollers 16, 18 are formed spring fixing holes 44, 46, in which the other ends 52, 54 of the torque springs 20 are secured. The ends 50 and 52, 54 and 56 of the torque springs 20 are formed symmetrically about a center axis. Consequently, the torque springs 20 are secured at the ends thereof to the stationary and free feed rollers 16, 18 and 17.

The arrangement of the engagement members 30,32 and engagement recesses 37,38 cooperate to form a lost motion type of connection between the stationary rollers 16 and 18 and the free roller 17.

With the slight urging force of the torque springs 20, the chord portions 16B, 18B of the stationary feed rollers 16, 18 are positioned flush with the chord portion 17B of the free feed roller 17. Namely, when the drive means 60 is inoperative, the free feed roller 17 is rotated in the direction indicated by the arrow M by the urging force of the torque springs 20. However, the engagement portions 30, 32 of the stationary feed rollers 16, 18 are engaged with the recesses 38, 38 of the free feed roller 17 so that the free feed roller 17 is inhibited from being rotated, and the three rollers come in a halt with the chord portions 16B, 17B, 18B aligned flush with each other.

Meanwhile, when the rotary shaft 22 is rotated in the direction indicated by the arrow M upon the drive of the drive means 60, the free feed roller 17 can be rotated together with the stationary feed rollers 16, 18 by the urging force of the torque springs 20.

Next, the operation for feeding the paper P using the paper feeder 1 so constituted as described above will be explained hereunder with reference to FIGS. 3 through 14.

Reference numerals P1, P2, P3 designate positions of the uppermost sheet of the paper P stacked in the paper cassette 3. When the stationary and free feed rollers 16, 18 and 17 are not in contact with the uppermost paper P, the paper P is located in the position P1. When the stationary feed roller 16 pushes the paper P down to the lowermost point, the uppermost paper sheet P is pushed down to the position P2. When the free feed roller 17 pushes the paper P down to the lowermost point, the pushed portion of the uppermost paper sheet P is pushed down to the position P3. The interval between the positions P2 and P3 is equal to a difference in diameter (about 1 mm) of the stationary and free feed rollers 16, 18 and 17, respectively.

Figure 3:
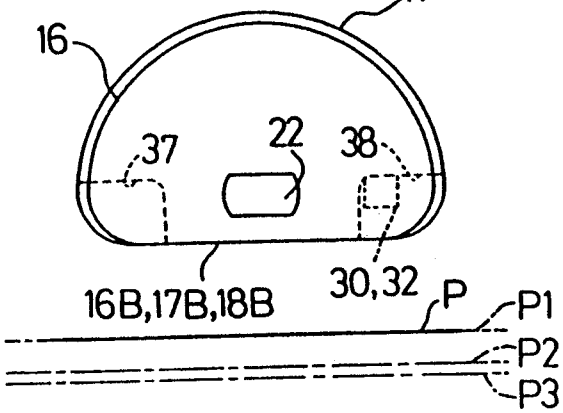

As illustrated in FIG. 3, when the drive means 60 is inoperative, the three rollers 16, 17, 18 are static with the respective chord portions 16B, 17B, 18B, which lie parallel to the paper P. In this case, the engagement members 30, 32 of the stationary feed rollers 16, 18 are engaged with the rear engagement recesses 38, 38 of the free feed roller 17.

Figure 4:
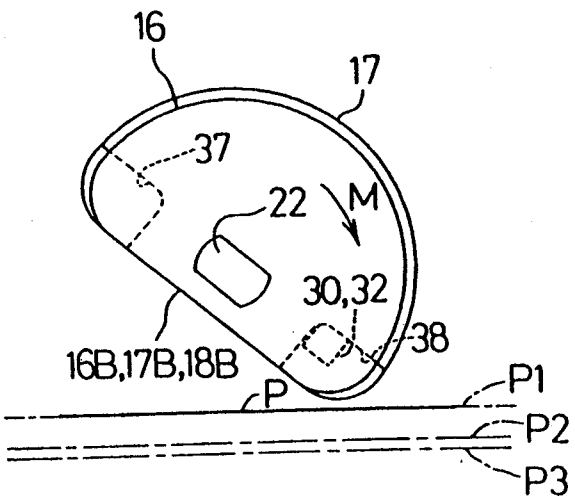

As shown in FIG. 4, when the rotary shaft 22 is rotated in the direction indicated by the arrow M depicted in FIG. 1 by the drive means 60, the stationary feed rollers 16, 18 are also rotated in the same direction. By the urging force of the torque springs 20, the free feed roller 17 is rotated in the direction indicated by the arrow M together with the stationary feed rollers 16, 18.

Figure 5:
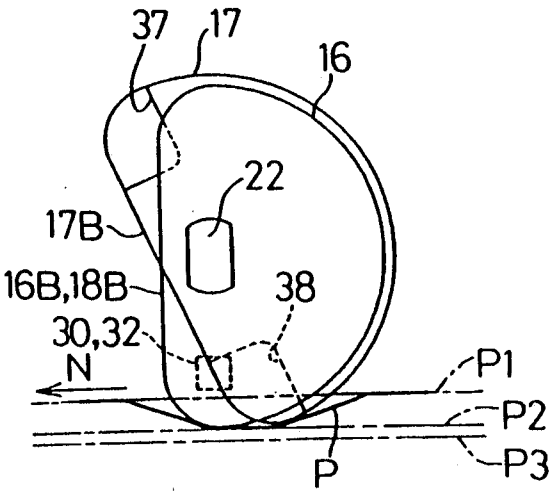
FIGS. 3 through 14 are views showing the operation of rollers.

As illustrated in FIG. 5, when the rotary shaft 22 is further rotated, the chord portion 17B of the free feed roller 17 abuts against the paper P in the position P2, thus stopping the rotation of the free feed roller 17. The stationary feed rollers 16, 18 continue to be rotated in contact with the paper P in the position P2. As a result, the stationary feed rollers 16, 18 feed the paper P toward the direction indicated by an arrow N. After that, the stationary feed rollers 16, 18 continue to feed the paper P, and the free feed roller 17 is rotated by being drawn by the paper P.

Figure 6:
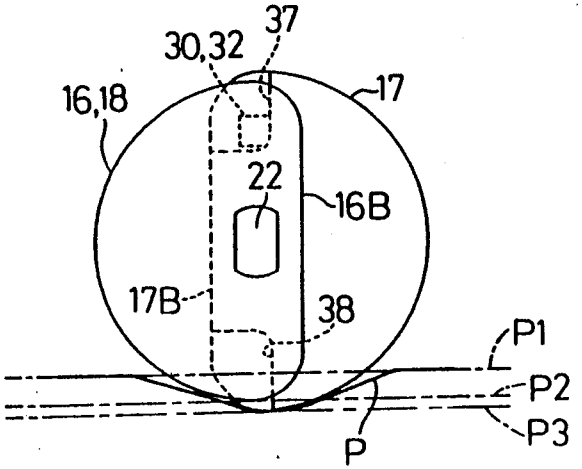

With the chord portion 17B of the free feed roller 17 oriented vertically as depicted in FIG. 6, the engagement members 30, 32 of the stationary feed rollers 16, 18 are engaged with the engagement recesses 37, 37. As a result, the three rollers 16, 17, 18 constitute an integral circular roller with the free feed roller 17 being driven by the stationary feed rollers 16, 18.

Figure 8:
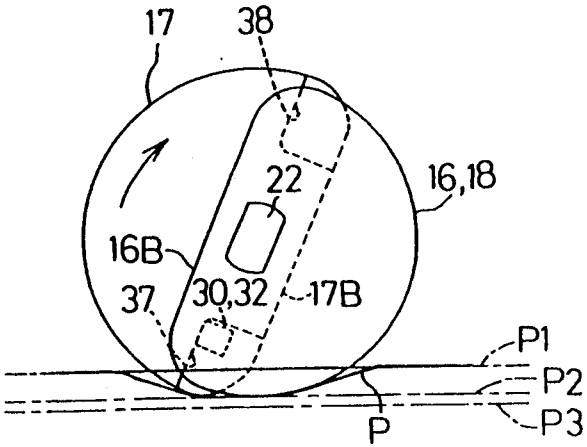
Figure 7:
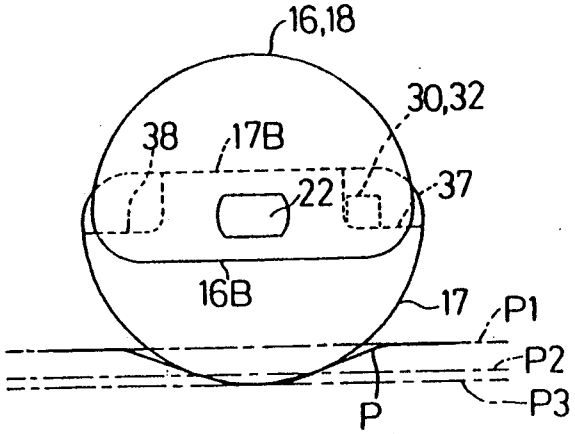

The three rollers 16, 17, 18 are rotated as an integral circular roller with the paper P pressed down to the position P3 by the free feed roller 17 from the state shown in FIG. 6 to that shown in FIG. 8. In this state, although the free feed roller 17 is biased to be independently rotated in the direction where the engagement recesses 38 are engaged with the engagement members 30, 32, i.e., clockwise in FIG. 7 by the torque springs 20, it cannot be independently rotated due to a frictional force generated between the free feed roller 17 and the paper sheet P, since the paper P is pushed down to the position P3 by the free feed roller 17 and thus loads the roller 17. Consequently, the three rollers continue to feed the paper P.

Figure 9:
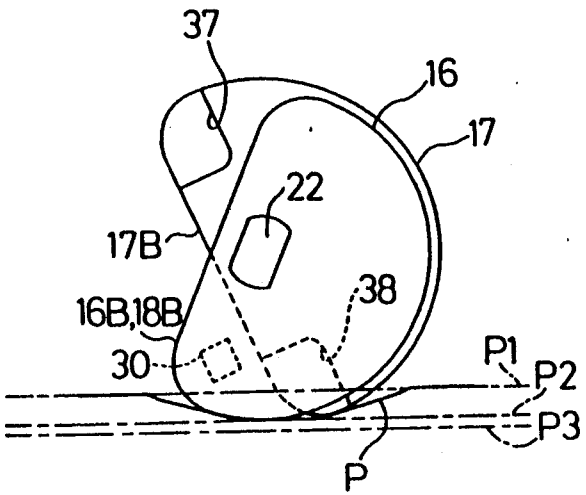

In the state illustrated in FIG. 8, the stationary feed rollers 16, 18 push the paper P down to the position P2 while no load is applied to the free feed roller 17. Accordingly, the free feed roller 17 is instantly rotated clockwise in FIG. 8 by the urging force of the torque springs 20 so that the chord portion 17B of the free feed roller 17 abuts against the paper P in the position P2 as shown in FIG. 9, to come in a halt. Meanwhile, the stationary feed rollers 16, 18 continue to feed the paper P while pressing the paper P down to the position P2.

Figure 10:
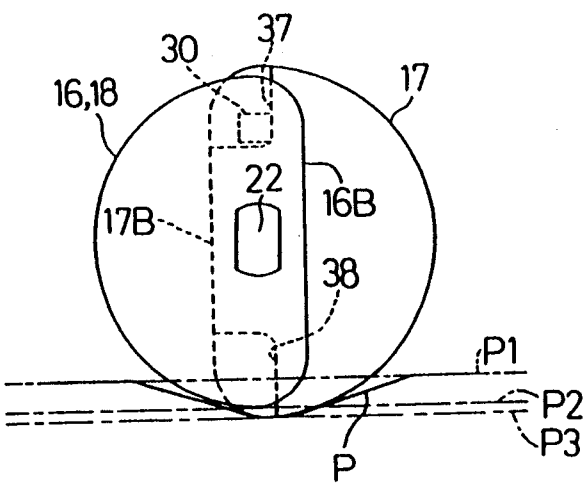

In FIG. 10 in the same manner as in FIG. 6, the engagement members 30, 32 of the stationary feed rollers 16, 18 are engaged with the engagement recesses 37, 37 of the free feed roller 17 with the chord portion 17B of the free feed roller 17 positioned vertically. Consequently, the three rollers 16, 17, 18 constitute an integral circular roller with the free feed roller 17 driven by the stationary feed rollers 16, 18.

The three rollers continue to feed the paper P by the repetition from the state shown in FIG. 5 to the state shown in FIG. 10.

Figure 11:
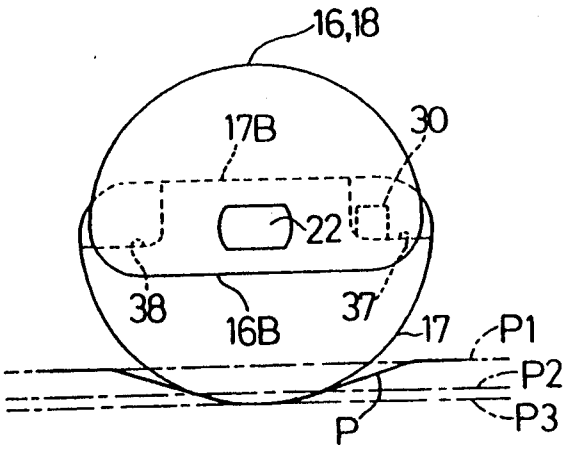

As illustrated in FIG. 11, when the tip end of the paper P reaches the transportation rollers 12, 14, the drive means 60 is brought into an inoperative state with the chord portions 16B, 18B of the stationary paper feed rollers 16, 18 down. After that, the transportation rollers 12, 14 continue to feed the paper P.

Figure 12:
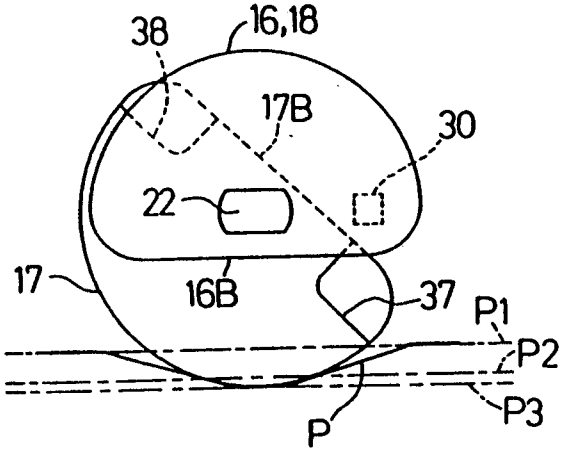

As shown in FIG. 12, the free feed roller 17 is continuously rotated while being drawn by the paper sheet P, which is being drawn by the transportation rollers 12, 14.

Figure 13:
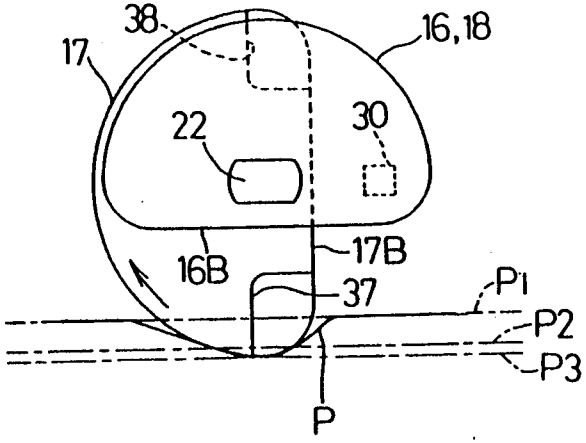

As depicted in FIG. 13, when the continuous rotation brings the free feed roller 17 into a non-load state, the free feed roller 17 is rotated clockwise in FIG. 13 by the urging force of the torque springs 20 as described above.

Figure 14:
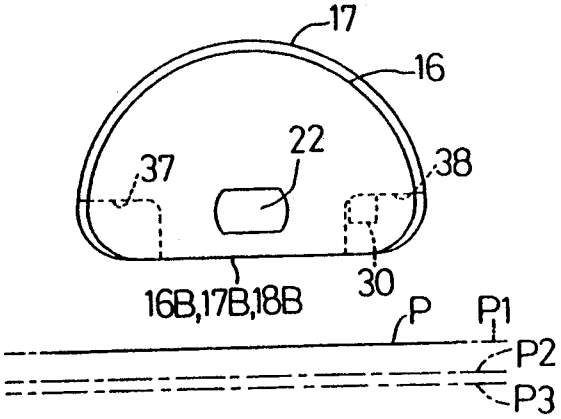

As illustrated in FIG. 14, the rotation of the free feed roller 17 is stopped in such a position that the engagement recesses 38, 38 of the free feed roller 17 are engaged with the engagement members 30, 32 of the stationary feed rollers 16, 18. In this stage, the three rollers are separated from the upper surface of the paper P, and then, the paper P is smoothly transported to the print unit by the transportation rollers 12, 14.

As apparent from the above description, the three rollers 16, 17, 18 continue to speedily feed the paper P in the same way as a circular roller until the paper P reaches the transportation rollers 12, 14. In addition, when the paper P reaches a predetermined position, the three rollers 16, 17, 18 are separated from the upper surface of the paper P as so-called sectorial rollers so that the paper P can be smoothly transported to the print unit in the non-load state.

The present invention is not limited to the above embodiment and can be practiced in various ways unless the spirit of the present invention is departed.

For example, the stationary and free feed rollers 16, 18 and 17 may be reversely arranged, or additional stationary and free feed rollers may be provided, namely, the number of paper feed rollers is not restricted. Furthermore, it is possible that the paper feed rollers 16, 17, 18 may have shapes different from those as shown and different from each other, so long as each of the rollers has a contact portion and a relief portion.

What is claimed is:

1. A sheet feeder comprising:

a cassette for containing a plurality of sheets therein;

a rotary shaft rotatably disposed along the direction of one lateral dimension of the sheets;

at least one sheet stationary feed roller rotated with said rotary shaft, said roller having a sheet contact portion, wherein, when said roller is rotated, the contact portion is brought into contact with the uppermost one of the plurality of sheets, and a relief portion wherein when said roller is rotated further, the roller is out of contact with the uppermost sheet;

a free paper feed roller rotatably fitted on said rotary shaft, and having a sheet contact portion for contact with the uppermost sheet and a sheet relief portion adapted to be out of contact with the uppermost sheet when the relief surface faces the cassette;

an engagement member formed on said stationary paper feed roller;

engagement recesses formed on said free paper feed roller and engageable with said engagement member;

urging means interposed between said stationary sheet feed roller and said free sheet feed roller for urging engagement of said engagement member with said engagement recesses in a normal state; and drive means for rotating said rotary shaft so as to transport the uppermost one of the plurality of sheets by said stationary and free sheet feed rollers, by rotation of said stationary sheet feed roller against the urging force of said urging means.

2. The sheet feeder according to claim 1, wherein said engagement recesses comprise a first engagement recess for engagement with said engagement member in an inoperative state of said stationary sheet feed roller, and second engagement recess for engagement with said engagement member in an operative state of said stationary sheet feed roller, stationary sheet feed rollers mounted on and rotated by said rotary shaft, each roller having an engagement member projecting toward the center in the direction of the width of the sheet, a curved sheet contact portion for contact with the uppermost one of the plurality of sheets in the cassette and a sheet relief portion which is spaced from the uppermost sheet when the relief portion faces said uppermost sheet;

a free sheet feed roller rotatably mounted on said rotary shaft, and having first engagement recesses for engagement with said engagement members at a time of non-rotation of said stationary sheet feed rollers, second engagement recesses for engagement with said engagement members at a time of rotation of said stationary sheet feed rollers and a curved paper contact portion in contact with the uppermost sheet, wherein said stationary and free sheet feed rollers constitute an integral roller having a substantially circular cross-section by the engagement of said engagement members with said second engagement recesses;

urging means interposed between said stationary sheet feed rollers and said free sheet feed roller, respectively, and for urging said engagement member into engagement with said first engagement recesses in a normal state;

a pair of transportation rollers disposed upstream in the sheet transportation direction beyond said stationary and free sheet feed rollers; and drive means for rotating said rotary shaft to transport the uppermost one of the plurality of sheets by said stationary and free sheet feed rollers by rotation of said stationary paper feed rollers against the urging force of said urging means, and to stop the rotation of said rotary shaft with said sheet relief portions of said stationary sheet feed rollers facing the uppermost sheet in the cassette when the leading edge of a fed sheet reaches said transportation rollers.

3. The sheet feeder according to claim 2, wherein said free sheet feed roller feeds the uppermost sheet with said engagement member engaged with said second engagement recess.

4. The sheet feeder according to claim 2, wherein the sheet contact portions of said stationary and free sheet feed rollers are formed in a curved shape.

5. The sheet feeder according to claim 4, wherein the diameter of said sheet contact portion of said free sheet feed roller is slightly larger than that of said sheet contact portion of said stationary sheet feed roller, whereby the rotation of said free sheet feed roller is stopped when said first engagement recess is disengaged from said engagement member and whereby said sheet contact portion of said free sheet feed roller is brought into driving contact with the uppermost sheet by engagement of said engagement member with said second engagement recess.

6. The sheet feeder according to claim 5, wherein said free sheet feed roller is rotated in a direction such that said first engagement recess is engaged with said engagement member when the relief portion of said stationary roller faces the uppermost sheet in the cassette.

7. The sheet feeder according to claim 1, further comprising a pair of transportation rollers disposed upstream in the paper transportation direction beyond said stationary and free sheet feed rollers, and wherein said drive means stops the rotation of said rotary shaft with said sheet relief portion of said stationary sheet feed roller facing the sheets in the cassette when the leading edge of the uppermost sheet reaches said transportation rollers.

8. A sheet feeder comprising:

a sheet cassette for containing a plurality of sheets therein;

a rotary shaft rotatably disposed along the direction of one lateral dimension of the sheets.

9. The sheet feeder according to claim 8, wherein said free sheet feed roller feeds the uppermost sheet with said engagement members engaged with said second engagement recesses.

10. The sheet feeder according to claim 8, wherein the diameter of said sheet contact portion of said free sheet feed roller is slightly larger than those of said sheet contact portions of said stationary sheet feed rollers, whereby rotation of said free sheet feed roller is stopped when said first engagement recesses are disengaged from said engagement members and whereby the sheet contact portion of said free sheet feed roller is brought into driving contact with the uppermost sheet by engagement of said engagement member with said second engagement recesses.

11. The sheet feeder according to claim 8, wherein said urging means comprise spring members, each stationary sheet feed roller having a spring fixing means for fixing a first end of each spring member, and said free sheet feed roller having spring fixing means for fixing a second end of each of the spring members.

12. The sheet feeder according to claim 8, wherein said free sheet feed roller has a sheet relief portion for being disposed out of contact with the uppermost sheet, said sheet contact portions of said stationary and free sheet feed rollers are formed into chord shapes, and said sheet relief portions are aligned with each other when said first engagement recesses are engaged by said engagement members.

13. The sheet feeder according to claim 12, wherein said free sheet feed roller is rotated by the transportation of the sheets by said transportation rollers and said sheet relief portion of said free sheet feed roller comes to a halt flush with said sheet relief portions of said stationary sheet feed rollers after said drive means stops the rotation of said rotary shaft.

14. A sheet feeder comprising:

a holding means for holding a stack of sheets;

a rotatable member mounted adjacent the holding means;

means for driving the rotatable member;

a first sheet engaging member mounted on the rotatable member for rotation with the rotatable member;

a second sheet engaging member mounted on the rotatable member for rotation with respect to the rotatable member about the axis of rotation of the rotatable member;

the first sheet engaging member having a peripheral surface formed of a curved sheet engaging portion and a relief portion extending from one end of the curved portion to an opposite end of the curved portion, said relief portion being spaced from the uppermost sheet in the stack when facing the stack;

the second sheet engaging member having a peripheral surface formed of a curved sheet engaging portion in the shape of a part of a circle and a relief portion extending from one end of the circular portion to an opposite end of said circular portion, said relief portion being spaced from the uppermost sheet in the stack when facing the stack;

a lost motion drive means coactive between the first sheet engaging member and the second sheet engaging member; and a rotational drive energy storing member coactive between the first sheet engaging member and the second sheet engaging member.

15. The sheet feeder as in claim 14, wherein the curved portions of the first sheet engaging member and the second sheet engaging member each form a portion of a circle and wherein the relief surface of the first and the second sheet engaging member each form a chord of a circle with the respective circular portions.

16. The sheet feeder as in claim 14, wherein the lost motion drive means comprises an elongate member extending from the first sheet engaging member in the direction of the axis of rotation of the rotatable member and engageable with engagement means located at each end of the circular portion of the second sheet engaging means.

17. The sheet feeder as in claim 14, wherein the energy storing member comprises a spring member engaged between the first sheet engaging member and the second sheet engaging member.

18. The sheet feeder as in claim 17, wherein the energy storing member comprises a coil spring mounted coaxially with respect to the rotatable member, with one end engaged with the first sheet engaging member and a second end engaged with the second sheet engaging member.

19. The sheet feeder as in claim 14, wherein the peripheral curved portions of the first and second sheet engaging members each form a portion of a circle, the diameter of the curved portion of the second sheet engaging member being larger than the diameter of the curved portion of the first sheet engaging member.

20. The sheet feeder as in claim 14, wherein the lost motion drive means comprises a first engagement surface at one end of the curved surface of the second sheet engaging member, an engagement member extending from the first sheet engaging member for engagement with the engagement surface when the first sheet engaging member is in an inoperative state facing an uppermost sheet of said stack of sheets.

* * * * *